US005557804A

United States Patent [19]

Ovortrup et al.

[11] Patent Number: 5,557,804

[45] Date of Patent: Sep. 24, 1996

[54] PROTECTIVE APPLIANCE

[75] Inventors: Klaus Ovortrup, Hellerup; Henrik Jeppesen, Holte, both of Denmark

[73] Assignee: Ovortrup ApS, Lyngby, Denmark

[21] Appl. No.: 340,745

[22] Filed: Nov. 16, 1994

[30] Foreign Application Priority Data

Nov. 16, 1993 [DK] Denmark ..... 1293/93

[51] Int. Cl.[6] ..... A41D 13/00; A61F 13/00

[52] U.S. Cl. ..... 2/23; 2/2; 128/891; 128/888

[58] Field of Search ..... 2/22, 23, 24, 2; 128/888, 889, 891, 892

[56] References Cited

U.S. PATENT DOCUMENTS

| | | | |
|---|---|---|---|
| 907,050 | 12/1908 | Hestness | 2/23 |
| 1,669,085 | 5/1928 | Guyon | 2/23 |
| 2,561,872 | 7/1951 | Krinick | 2/24 |
| 3,044,075 | 7/1962 | Rawlings . | |
| 3,465,364 | 9/1969 | Edelson . | |
| 3,484,868 | 12/1969 | Davenport, Jr. . | |
| 3,562,221 | 9/1970 | Garber . | |
| 4,462,115 | 7/1984 | Carlson et al. | 2/2 |
| 4,573,216 | 3/1986 | Wortberg | 2/2 |
| 4,641,641 | 2/1987 | Strock . | |
| 4,926,883 | 5/1990 | Strock . | |
| 5,020,547 | 6/1991 | Strock | 128/891 |
| 5,062,433 | 11/1991 | Kummer . | |
| 5,289,830 | 3/1994 | Levine . | |
| 5,405,312 | 4/1995 | Jacobs | 128/892 X |

FOREIGN PATENT DOCUMENTS 09181991 3/1992 Denmark .

OTHER PUBLICATIONS

International Search Report for priority application DK 1293/93, dated 8 May 1994.

*Primary Examiner*—John J. Calvert
*Assistant Examiner*—Shirra L. Jenkins
*Attorney, Agent, or Firm*—Merchant, Gould, Smith, Edell, Welter & Schmidt

[57] ABSTRACT

A protective appliance to be worn by an individual for protecting a body part of the individual, which body part is covered by a piece of clothing, includes an inner shell part of a generally convex configuration to be arranged such that one side of the inner shell part is covered by the piece of clothing at the body part of the individual. The inner shell part includes opposite flange members and a central curved member integrally connected to the flange members which have configurations allowing the flange members to be arranged in facial contact with respective body surface parts adjacent to the body part of the individual as the central curved member bridges the flange members so as to cover the body part of the individual without contacting the body part, and as the flange members are arranged in facial contact with the body surface parts. The protective appliance further includes an outer shell part to be arranged opposite to the inner shell part relative to the piece of clothing so as to sandwich the piece of clothing between the inner shell part and the outer shell part, and a fixation part for fixating the inner shell part and the outer shell part relative to one another, sandwiching the piece of clothing therebetween.

17 Claims, 3 Drawing Sheets

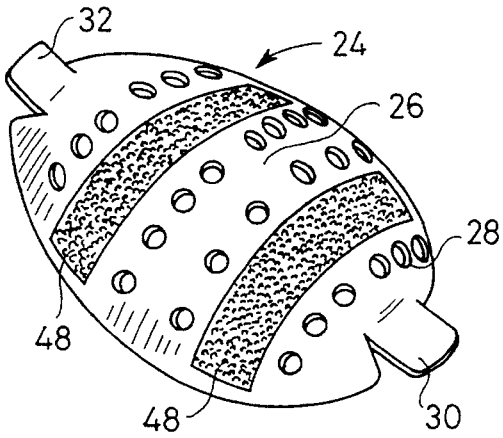
Fig. 6
Fig. 8
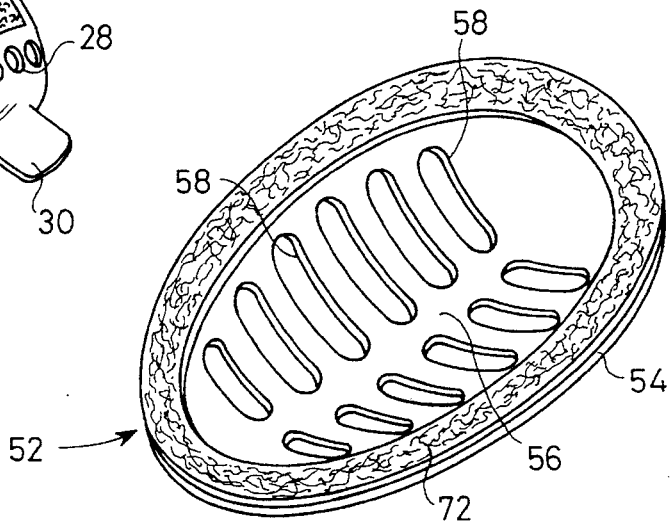
Fig. 7
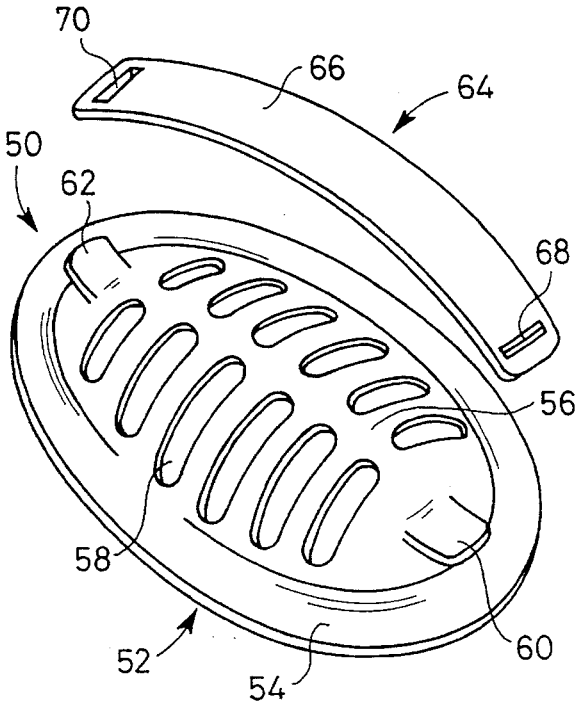
Fig. 9
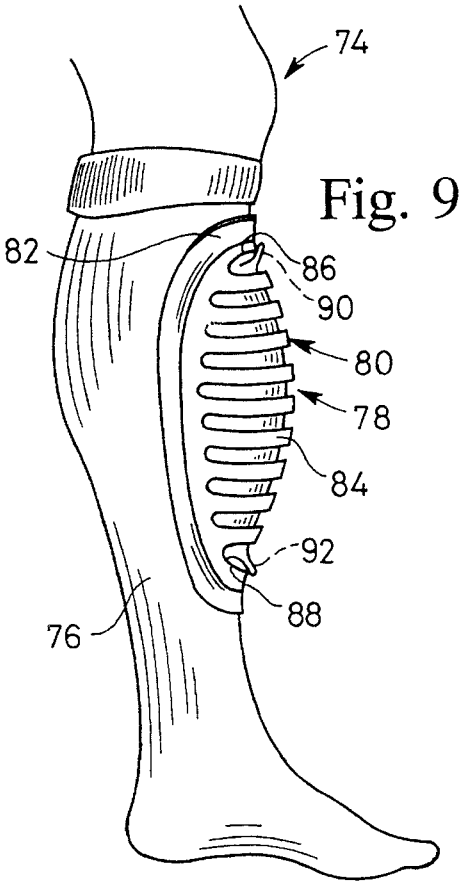

PROTECTIVE APPLIANCE

BACKGROUND OF THE INVENTION

The present invention relates to the technical field of protecting an individual against body injury, and more particularly, to the technical field of protecting a specific part of the individual's body against injury through mechanical impact. The present invention further generally relates to a protective appliance to be worn by the individual for protecting a specific body part.

An extremely large number of hip fractures is registered each year. Hip fractures are particularly common to elderly people and individuals suffering from weakened bones, e.g. osteoporosis, neurotic disorder, e.g. Alzheimer's disease, and further individuals having weakened bones caused by extensive medication which may cause weakening of the bones of the individual and further in numerous instances may cause the individual to be confused and make the individual susceptible to slipping, falling, or otherwise to be exposed to mechanical severe impacts which may cause bone fractures, such as hip fractures. Numerous protective appliances have been developed for protecting in particular hip joints of individuals. Among the references disclosing protective appliances of the above type, reference is made to U.S. Pat. No. 3,044,075, U.S. Pat. No. 3,484,868, U.S. Pat. No. 3,465,364, U.S. Pat. No. 4,641,641, U.S. Pat. No. 4,926,883, U.S. Pat. No. 5,062,433, and U.S. Pat. No. 5,289,830 which are further hereby incorporated in the present specification by reference.

Although the protective appliances may provide protection to the individual wearing the protective appliance, the protective appliance often on the one hand causes severe discomfort, while the protective appliance is worn by the individual in question, and on the other hand is extremely difficult to apply and maintain in correct positioning relative to the hip joint. Most protective appliances to be used for hip joint protection are to be fixated relative to the skin surface of the individual through adhesive fixation, or alternatively to be fixated by means of belts or similar fixation elements. A further protective appliance is known which is adapted to be received within a pocket of a pair of underpants to be worn by the individual. The correct positioning of the protective appliance which is received in the pocket of the underpants, however, is completely dependent on a correspondence between the anatomy of the individual wearing the underpants and the intentional anatomy of the design of the underpants.

SUMMARY OF THE INVENTION

An object of the present invention is to provide a protective appliance which is easily positioned and fixated relative to a specific body part of the individual by the individual wearing the protective appliance.

A particular advantage of the present invention relates to the fact that the protective appliance according to the present invention is applied and worn without the need of additional fixation means such as adhesive tape, belts, separate supporting clothing, including pockets for the receipt of the protective appliance, or the like.

A particular feature of the present invention relates to the fact that a protective appliance to be used for protecting a specific body part is, in accordance with the teaching of the present invention, provided comprising a minimum number of components which are easily fixated relative to the body part in question by the individual or personnel nursing the individual, through the utilization of the ordinary clothing of the individual.

The above object, the above advantage, and the above feature together with numerous other objects, advantages, and features which will be evident from the below detailed description of the present invention are in accordance with the teaching of the present invention obtained by a protective appliance according to the present invention to be worn by an individual for protecting a body part of said individual, which body part is covered by a piece of clothing, comprising:

a shielding element of a generally convex configuration to be arranged covered by or covering said piece of clothing at said body part of said individual, said shielding element including opposite support segments and a central curved segment integrally connected to said support segments, said support segments having configurations allowing said support segments to be arranged in facial contact with respective body surface parts adjacent to said body part of said individual, and said central curved segment bridging said support segments so as to cover said body part of said individual without contacting said body part, as said support segments are arranged in facial contact with said body surface parts, a locking element to be arranged opposite to said shielding element relative to said piece of clothing so as to sandwich said piece of clothing between said shielding element and said locking element, and fixation means for fixating said shielding element and said locking element relative to one another, sandwiching said piece of clothing therebetween.

According to the teachings of the present invention, a two-part protective appliance is provided, comprising a shielding element and a locking element which are simply fixated relative to one another by means of the fixation means for sandwiching the clothing of the individual between the shielding element and the locking element and causing a proper and adequate positioning and fixation of the two-part protective appliance relative to a specific part of the individual wearing the protective appliance. The protective appliance according to the present invention may be implemented in accordance with specific anatomic requirements for protecting specific body parts such as the elbows, the shoulders, the back, the chest, the hip joint, the buttocks, the knees, the crus, or any other part of the individual, as the protective appliance according to the present invention is, in accordance with the teachings of the present invention, fixated relative to the intentional application site by simply sandwiching the individual's clothing covering the body part in question between the shielding element and the locking element of the protective appliance. The protective appliance according to the present invention is particularly applicable in connection with mechanical protection of the individual wearing the protective appliance, including protection against so-called bed sores or bed wounds. In the below description, the protection of hip joints is particularly addressed, although the present invention is by no means limited to the technical field of protecting hip joints. Dependent on the specific application of the protective appliance, the overall configuration of the protective appliance, of course, has to be adapted to the anatomic requirements, and in particular the body part in question.

The shielding element may in accordance with the presently preferred embodiment of the protective appliance define a circumferential rim of a substantially elliptic configuration. Alternatively, the shielding element may define a circumferential rim of a configuration corresponding to the intentional application of the protective appliance, i.e. the anatomic configuration of the body part to be protected by the protective appliance. Provided the body part to be protected is the hip bone or hip joint of an individual, the shielding element preferably, as described above, is of an overall elliptic configuration defining a substantially plane rim surface.

The support elements of the shielding element are preferably arranged so as to provide an overall support of the central curved segment relative to the body part to be protected by the protective appliance and are preferably further of a configuration corresponding to the anatomic requirements and in particular the configuration of the body surface parts adjacent to the body part to be protected by means of the protective appliance. Provided the protective appliance is intended to be used for protecting a hip bone or hip joint, the support segments preferably constitute substantially plane support segments provided at the circumferential rim, and further preferably constitute a circumferential flange part provided at the circumferential rim which is further, as stated above, preferably of a substantially elliptic configuration.

Dependent on the intentional application of the protective appliance, the central curved segment of the shielding element, which segment constitutes the basic protective element of the protective appliance, is provided in a configuration providing the intentional covering of the body part in question. The central curved segment may, thus, be provided in any appropriate, yet anatomicly defined configuration fulfilling a specific protective application requirement. In connection with the protection of hip joints, the central curved segment of the shielding element is in accordance with the presently preferred embodiment of the protective appliance according to the present invention constituted by a continuous surface segment which is preferably further of a generally convex configuration. The continuous surface segment may, in order to provide appropriate venting of the skin of the body part covered by the protective appliance, preferably be provided with apertures. The central curved segment of the shielding element may alternatively be provided composed of a plurality of curved or rectilinear bar elements which are connected to the support segments of the shielding element, e.g. providing a mesh of mutually connected bar elements.

The fixation means for fixating the shielding element and the locking element relative to one another in the intentional position relative to the body part and sandwiching the piece of clothing worn by the individual in question may be constituted by separate fixation means such as bolts and nuts, bayonet locking means, snap-fastener means etc. According to the presently preferred embodiments of the protective appliance of the present invention, irrespective of the intentional application of the protective appliance, i.e. the relevant body part to be protected by the protective appliance, the fixation means, however, preferably constitute elements which are integral with the shielding element and/or locking element and further preferably constitute cooperating male and female locking means provided at the shielding element and the locking element.

According to two alternative further embodiments of the protective appliance according to the present invention, the male and female locking means are constituted by flange segments of the locking elements and apertures of the shielding element, respectively, or are alternatively constituted by apertures of the locking element and flange segments of the shielding elements, respectively. The locking element may in accordance with a further embodiment of the protective appliance according to the present invention constitute a separate locking element constituted by a bar of a flexible material such as a bar of a plastic material which is further provided with, in accordance with the above embodiments, the male or female locking means.

Provided the shielding element comprises a central curved segment of a generally convex configuration, the locking element also preferably constitutes an element of a generally convex configuration complementary to the generally convex configuration of the shielding element. The locking element may, thus, constitute an inner or outer element relative to the shielding element to be arranged outside or inside the clothing worn by the individual.

In order to prevent that the shielding element causes injuries to the individual wearing the protective appliance, the shielding element is preferably made from a flexible material allowing a reduced flexing of the shielding element in order to reduce the mechanical impact to the body surface parts adjacent to the body part covered and protected by the shielding element in case the shielding element is exposed to a mechanic impact, such as a blow or strike caused by e.g. a fall.

BRIEF DESCRIPTION OF THE DRAWINGS

The present invention will now be further described with reference to the drawings, in which

FIG. 6 is a perspective and schematic top view of a modified embodiment of the locking element of the first embodiment shown in FIGS. 1 and 2, FIG. 7 is a perspective and schematic top view, similar to the view of FIG. 1, of a second embodiment of the protective appliance according to the present invention, comprising a shielding element and a locking element, FIG. 8 is a perspective and schematic bottom view, similar to the view of FIG. 2, of the shielding element of the second embodiment of the protective appliance also shown in FIG. 7, and FIG. 9 is a third embodiment of the protective appliance according to the present invention, constituting a shinbone protector.

DETAILED DESCRIPTION OF THE PREFERRED EMBODIMENT

Figure 1:
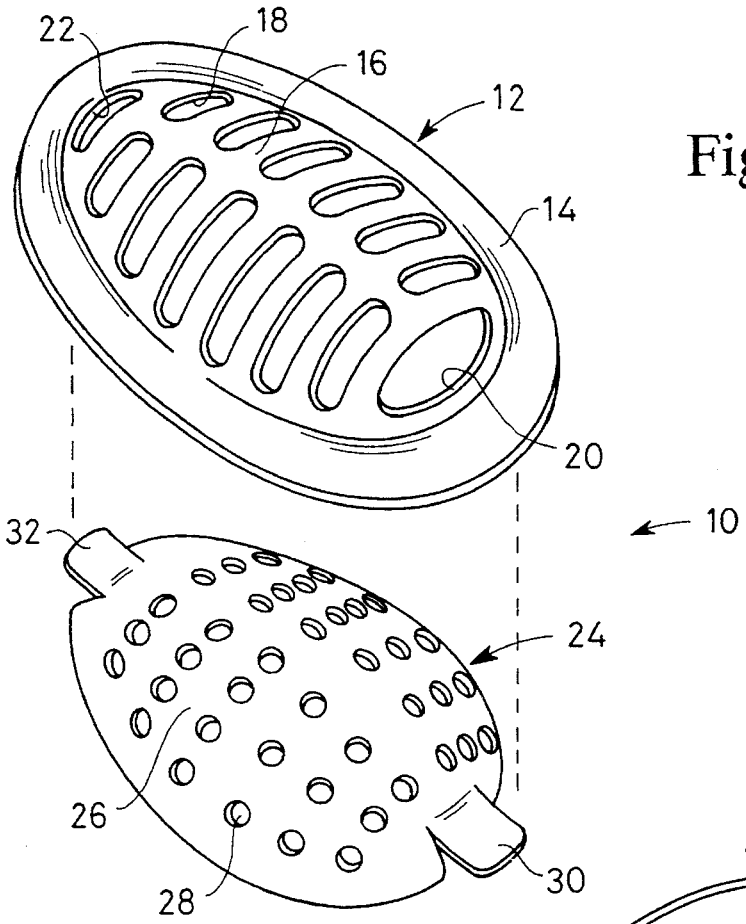
FIG. 1 is a schematic and perspective top view of a first and presently preferred embodiment of a protective appliance according to the present invention comprising a shielding element and a locking element, constituting a hip bone or hip joint protector.
Figure 2:
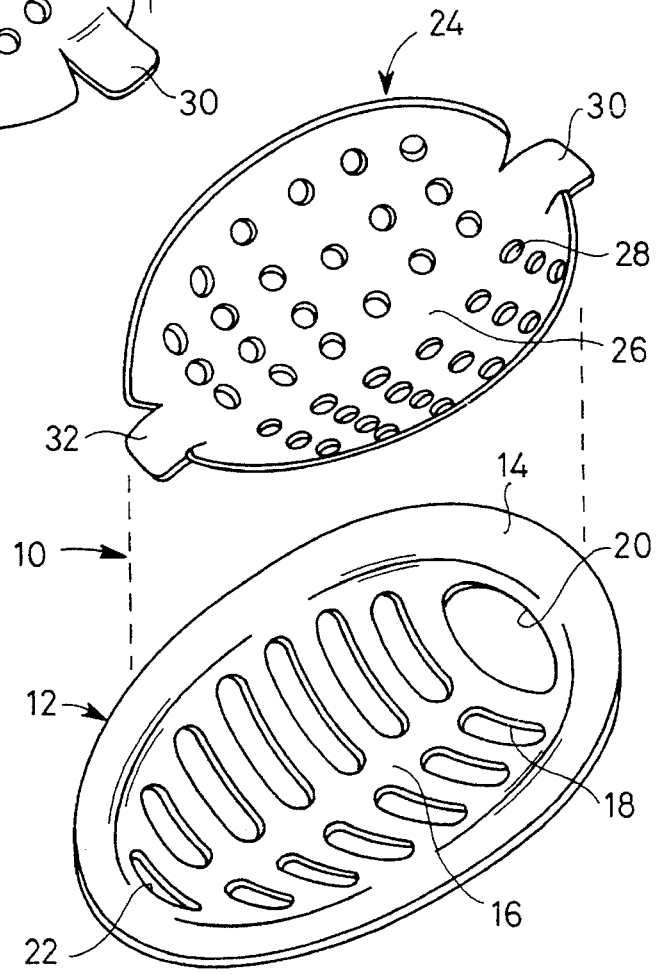
FIG. 2 is a perspective and schematic bottom view of the first embodiment of the protective appliance also shown in FIG. 1, FIGS. 3–5 are perspective and schematic views illustrating the technique of applying the first embodiment of the protective appliance shown in FIGS. 1 and 2.

In FIGS. 1 and 2, a first and presently preferred embodiment of a protective appliance according to the present invention is shown, constituting a protective appliance to be used for protecting the hip bone or hip joint of an individual wearing the protective appliance. In the below description, the first embodiment shown in FIGS. 1 and 2 is referred to as a hip protector and is in its entirety designated the reference numeral 10.

The hip protector 10 basically comprises two parts, viz. a first or outer shell part 12 and a second or inner shell part 24. The first or outer shell part 12 constitutes an integral part or component made from a durable and preferably fairly rigid plastic material or similar material, e.g. thermoplastics or thermosetting materials, such as PE (polyethylene), ABS (acrylonitril butadiene styrene), PP (polypropylene), PC (polycarbonate), composite materials including fiber glass, glass fiber reinforced plastic materials, carbon fiber reinforced plastic materials, and combinations thereof, or alternatively aluminum or the like. The outer shell part 12 may be produced by casting, moulding, cutting, pressure forming, or combinations thereof.

The first or outer shell part 12 constitutes a basically domed structure having an outer circumferential rim 14 to be arranged resting on the body of the individual wearing the hip protector. Within the outer circumferential rim 14, a domed cover 16 is provided constituting the central shielding or protecting cover of the protective appliance or hip protector 10. The domed cover 16 is, for reasons of comfort, provided with a plurality of apertures, one of which is designated the reference numeral 18, which apertures are provided for venting the space defined within the domed cover 16 and consequently reduce the skin-heating effect of wearing the hip protector 10 by venting the inner space of the hip protector.

Apart from the apertures 18 constituting venting apertures, two additional apertures 20 and 22 or female locking means are provided, constituting a first and a second fixation aperture, respectively. The first and second fixation apertures 20 and 22 opposite each other are adapted to cooperate with mating fixation flanges or male locking means constituted by opposite first and second fixation flanges 30 and 32, respectively, of the second or inner shell part 24 as will be described in greater details below with reference to FIGS. 3–5.

The second or inner shell part 24 constitutes an integral part or component made from a durable and preferably fairly rigid plastic material or similar material, e.g. thermoplastics or thermosetting materials, such as PE (polyethylene), ABS (acrylonitril butadiene styrene), PP (polypropylene), PC (polycarbonate), composite materials including fiber glass, glass fiber reinforced plastic materials, carbon fiber reinforced plastic materials, and combinations thereof, or alternatively aluminum or the like. The second or inner shell part 24 may be produced by casting, moulding, cutting, pressure forming, or combinations thereof.

The second or inner shell part 24 is basically of an elliptic configuration and comprises a central curved inner shell 26 which is of an overall convex configuration which is complementary to the convex configuration of the domed cover 16 of the first or outer shell part 12.

Figure 3:
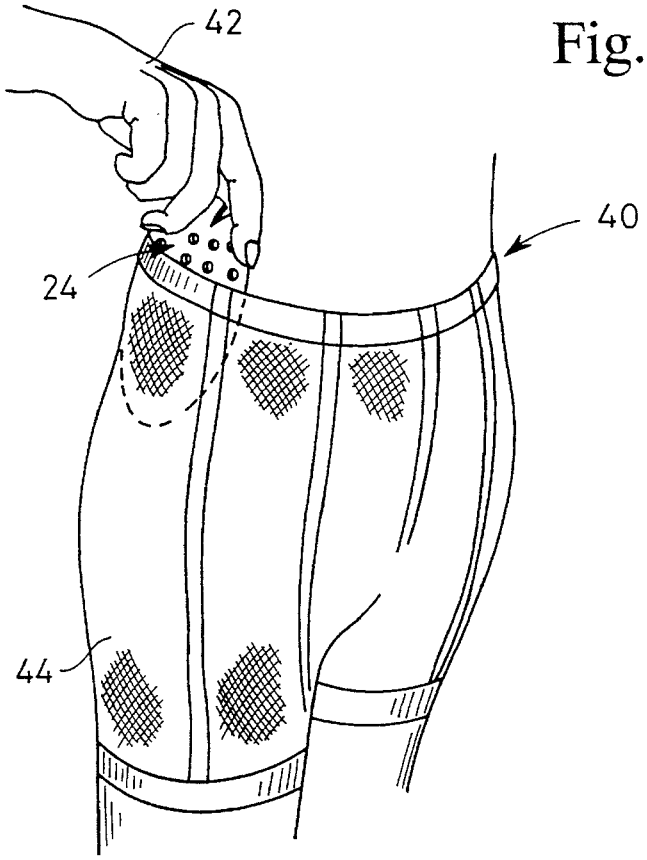
Figure 5:
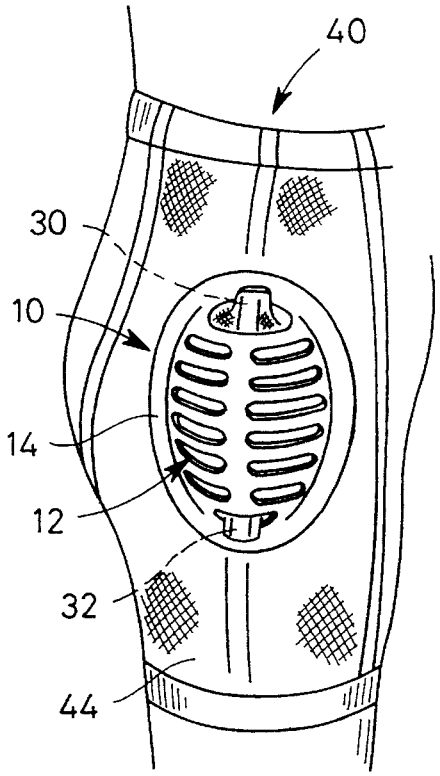

The second or inner shell part 24 is preferably made from an elastic material, allowing that the fixation flanges 30 and 32 may be slightly deformed along with the inner shell 26 of the second or inner shell part 24 so as to allow the fixation flanges 30 and 32 to be received within the first and second fixation apertures 20 and 22, respectively, of the first or outer shell part 12 for fixating the shell parts 12 and 24 relative to one another, as will be described in greater details below with reference to FIGS. 3–5. The first and second fixation flanges 30 and 32 define an overall length of the second or inner shell part 24, which length is substantially longer than the maximum distance defined by the fixation apertures 20 and 22.

Like the first or outer shell part 12, the second or inner shell part 24 is provided with apertures, one of which is designated the reference numeral 28, which are provided in triplicate to be arranged in registration with a respective aperture 18 of the first or outer shell part 12, provided the second or inner shell part 24 is received within and fixated relative to the first or outer shell part 12, as will be described below with reference to FIGS. 3–5.

In FIG. 1, the hip protector 10 is shown from an upper or outer side, whereas in FIG. 2 the hip protector is shown from a lower or inner side. Thus, in FIG. 1, the outer surfaces of the first and second shell parts 12 and 24, respectively, are disclosed, which outer surfaces are facing outwardly from the body of the individual wearing the hip protector, whereas, in FIG. 2, the inner surfaces of the first and second shell parts 12 and 24, respectively, are shown, which inner surfaces face towards the body of the individual wearing the hip protector 10.

The hip protector 10 is used for protecting the hip bone or hip joint of a person, such as an elderly individual. In FIG. 3, the individual is shown designated the reference numeral 40, which individual has a right hand designated the reference numeral 42 in its entirety. The individual further wears a pair of underpants 44. The hip protector is applied and fixated relative to the hip bone shown in FIG. 4 and designated the reference numeral 46, in an extremely simple and elegant manner, using the underpants 44 as support for carrying the hip protector in correct position relative to the hip bone 46. Firstly, the second or inner shell part 24 is, as shown in FIG. 3, introduced under the underpants 44, as the individual 40 pushes the second or inner shell part 24 under the underpants 44 by using his or her hand 42 and positions the second or inner shell part 24 in proper position relative to the hip bone 46. Thereupon, the first or outer shell part 12, which constitutes the main protective element of the hip protector 10, is simply fixated relative to the second or inner shell part 24 by applying the first or outer shell part 12 from the outside of the underpants 44 as shown in FIG. 4.

Figure 4:
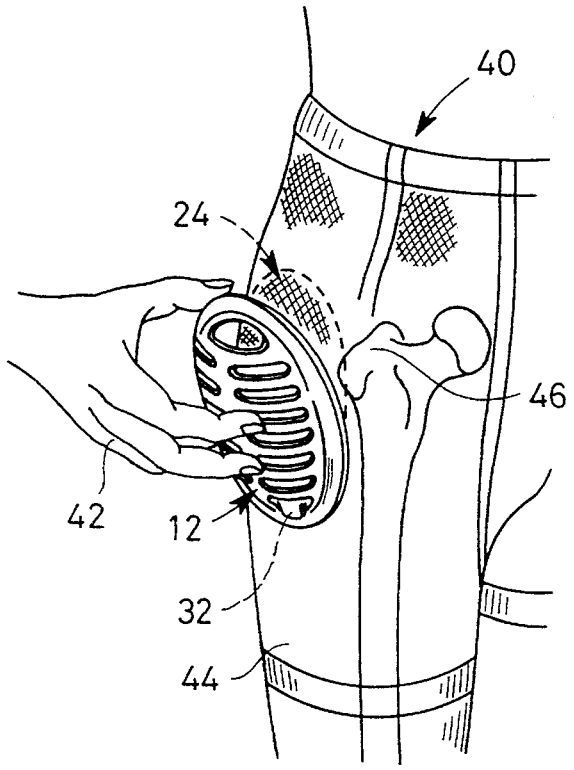

In FIG. 4, the second fixation flange component 32 is received within the second fixation aperture 22 of the first or outer shell part 12, as the fabric of the underpants 44 is stretched around the second fixation flange 32. Thereupon, the individual wearing the hip protector 10 raises the first or outer shell part 12 from the position shown in FIG. 4, causing the first fixation flange 30 to be snap-fitted within the first fixation aperture 20 of the first or outer shell part 12, causing the fabric of the underpants 44 to be stretched around the first fixation flange 30 and finally causing a fixation and arresting of the first and second shell parts 12 and 24, respectively, relative to the hip bone 46 of the individual as the fabric of the underpants 44 is sandwiched between the first and second shell parts 12 and 24, respectively, as shown in FIG. 5, illustrating in greater details the arresting of the curved or outer shell part 12 relative to the first and second fixation flanges 30 and 32 of the second or inner shell part 24 of the hip protector.

In FIG. 6, a slightly modified embodiment of the second or inner shell part 24 is shown which differs from the above described embodiment shown in FIGS. 1 and 2 in that two burr fixation tapes 48 are provided, serving the purpose of temporarily fixating the second or inner shell part 24 relative to the inner side of the underpants 44 and further for improving the overall fixation of the assembled hip protector 10, as the burr tape 48 causes a fixation of the second or inner shell part 24 relative to the inner side of the fabric of the underpants 44 after the assembly of the first and second shell parts 12 and 24 as described above with reference to FIGS. 3–5.

In FIGS. 7 and 8, a second or alternative embodiment of the protective appliance constituting a hip protector is shown, which second embodiment is designated the reference numeral 50 in its entirety and constitutes an embodiment which differs from the above described first embodiment in that the overall functions of the inner and outer parts of the hip protector are basically inverted. Thus, the hip protector 50 comprises an inner shell part 52 which differs from the above described inner shell part 24 in that the shell part 52 is of a configuration and fulfils the same basic protective purpose as the first or outer shell part 12 of the hip protector 10 described above with reference to FIGS. 1–5. The inner shell part 52 comprises an outer circumferential rim 54 of an elliptical configuration defining an inner domed cover 56 which, like the domed cover 16 of the outer shell part 12 of the hip protector 10, is provided with apertures, one of which is designated the reference numeral 58.

The inner shell part 52, however, differs from the outer shell part 12 of the hip protector 10 in that the inner shell part 52 is provided with first and second fixation flanges 60 and 62, respectively, fulfilling the same purpose as the first and second fixation flanges 30 and 32, respectively, of the second or inner shell part 24 of the hip protector 10. The inner shell part 52 further differs from the outer shell part 12 of the hip protector 10 in that the lower or inner side surface of the outer circumferential rim 54 is covered by a layer constituting a cushion 72 serving the overall purpose of providing a soft and skin-gentle fixation of the inner shell part 52 relative to the skin surface of the individual wearing the hip protector 50. The cushion 72 is disclosed in FIG. 8 further disclosing the inner side of the inner shell part 52. The hip protector 50 further comprises a fixation component 64 which basically comprises an elongated bar element 66 which is provided with first and second fixation apertures 68 and 70, respectively, provided at opposite ends of the bar element 66.

The hip protector 50 is basically used in the same manner as the hip protector 10 described above with reference to FIGS. 3–5, as the inner shell part 52 is introduced under the underpants of the individual wearing the hip protector and positioned correctly relative to the hip bone or hip joint of the individual. Thereupon, the fixation component 64 is fixated relative to the inner shell part 52 as the fixation apertures 68 and 70 of the bar element 66 are caused to receive the fixation flanges 60 and 62, respectively, jamming and sandwiching the fabric of the underpants between the flanges and the apertures and further between the outer side surface of the domed cover 56 and the inner side of the bar element 66. Like the above described first embodiment of the hip protector, the second embodiment may be amended by providing burr fixation tape or similar fixation components, e.g. at the inner side surface of the bar element 66. Further, the second embodiment may be amended by substituting the fixation flanges 60 and 62 of the inner shell part 52 by fixation apertures and by providing outwardly protruding flange components at the inner side surface of the bar element 66. Alternatively, the outer rims of the bar element 66 may constitute flange components for cooperating with the above described fixation apertures of the alternative embodiment of the inner shell part 52.

In the above applications of the protective appliance constituting hip protectors, the protective appliance is used for protecting a hip bone or hip joint of the individual wearing the protective appliance. The protective appliance may in accordance with the teachings of the present invention be used for protecting other body parts of an individual wearing the protective appliance. Thus, in alternative applications of the teachings of the present invention, protective appliances are provided for protecting e.g. the elbows, the shoulders, the buttocks, the knees or the crus of the individual wearing the protective appliance in question.

In FIG. 9, a crus 74 of an individual is shown, which crus is covered by a sock 76. For protecting the crus of the individual, a crus protector 78 implemented in accordance with the teachings of the present invention is provided, comprising an outer shell part 80 similar to the first or outer shell part 12 of the first embodiment 10 described above with reference to FIGS. 1 and 2. The outer shell part 80, however, differs from the first or outer shell part 12 of the hip protector 10 in that the outer shell part is of an overall configuration allowing the crus protector to be positioned and supported by the crus of the individual. Thus, the outer shell part 80 defines an outer circumferential rim 82 which is formed in conformity with the crus. Like the above described first or outer shell part 12 of the hip protector 10, the outer shell part 80 defines a central domed cover 84 within the circumferential rim and is further provided with first and second fixation apertures designated the reference numerals 86 and 88, respectively. An inner shell part similar to the second or inner shell part 24 of the hip protector 10 is further provided, comprising first and second fixation flanges 90 and 92, respectively, for cooperating with the first and second fixation apertures 86 and 88, respectively, of the outer shell part 80 in a manner analogous to the fixation of the first or outer shell part 12 relative to the second or inner shell part 24 of the hip protector 10.

EXAMPLE 1

A prototype implementation of the first and presently preferred embodiment of the hip protector shown in FIGS. 1 and 2 was made from the below components:

The outer shell part 12 was made from PC (polycarbonate) by cutting by means of a CNC cutter and defined an overall length of 160 mm, an overall width of 110 mm and a height of 37 mm. The outer circumferential rim 14 was of a width of 16 mm and defined a curved lower side surface, providing a height of 9 mm at the apexes of the generally elliptic configuration above a plane support surface. The domed cover 16 included a total of eight apertures 18 and two fixation apertures 20 and 22 of the configuration shown in FIGS. 1 and 2.

The inner shell part 24 was made from PE (polyethylene) by cutting by means of a CNC cutter and defined an overall length of 129 mm, an overall width of 74 mm and a height of 15 mm. The inner shell part 24 defined a height of 5 mm at the apexes of the generally elliptic configuration above a plane support surface. Each of the fixation flanges defined a width of 15 mm and a length of 12 mm.

EXAMPLE 2

For hip bone or hip joint protection purposes, the outer shell part 12 and the inner shell part 24 of the hip protector 10 shown in FIGS. 1 and 2 are believed to fulfil the below dimensional requirements. The length of the outer shell part 12 may vary between 10 cm and 30 cm, preferably between 15 and 17 cm, the overall width of the outer shell part 12 may vary between 7 cm and 18 cm, preferably between 10 cm and 12 cm, and the overall height of the dome of the outer shell part 12 may vary between 2.5 cm and 7 cm, preferably between 3 cm and 4 cm. Similarly, the overall length of the inner shell part 24 may vary between 6 cm and 26 cm, preferably between 11.5 cm and 13.5 cm, the overall width of the inner shell part 24 may vary between 5 cm and 10 cm, preferably between 6 cm and 8 cm, and the overall height of the dome of the inner shell part 24 may vary between 1 cm and 4 cm, preferably between 2 cm and 3 cm. The actual dimensions of the outer and inner shell parts 12 and 24, respectively, are determined by the anatomy, and particularly the size of the individual to wear the hip bone or hip joint protector. The outer and inner shell parts 12 and 24, respectively, may be made from a durable and preferably fairly rigid plastic material or similar material, e.g. thermoplastics or thermosetting materials, such as PE (polyethylene), ABS (acrylonitril butadiene styrene), PP (polypropylene), PC (polycarbonate), composite materials including fiber glass, glass fiber reinforced plastic materials, carbon fiber reinforced plastic materials, and combinations thereof, or alternatively aluminum or the like. The outer and inner shell parts 12 and 24 may be produced by casting, moulding, cutting, pressure forming, or combinations thereof.

Although the invention has been described above with reference to specific and presently preferred embodiments of the protective appliance for use as a hip protector and a crus protector, the invention is by no means to be considered limited to the above described embodiments. For example, the fixation flanges can be located on the outer shell part, whereas the fixation apertures can be located on the inner shell part. Thus, the above embodiments may be modified and amended in numerous ways without departing from the scope and spirit of the present invention. Thus, the scope of the present invention is to be considered defined by the appending claims.

We claim:

1. A protective appliance to be worn by an individual for protecting a body part of said individual, which body part is covered by a piece of clothing, comprising:

an inner shell part of a convex configuration to be arranged such that one side of the inner shell part is covered by .said piece of clothing at said body part of said individual, said inner shell part including opposite first and second fixation flanges and a central curved inner shell integrally connected to said fixation flange, said fixation flanges having configurations allowing said fixation flanges to be arranged in contact with respective body surface parts adjacent to said body part of said individual, and said central curved inner shell bridging said fixation flanges so as to cover said body part of said individual without contacting said body part, as said fixation flanges are arranged in contact with said body surface parts;

an outer shell part to be arranged opposite to said inner shell part relative to said piece of clothing so as to sandwich said piece of clothing between said inner shell part and said outer shell part, the outer shell part having opposite first and second fixation apertures; and fixation means for fixating said inner shell part and said outer shell part relative to one another, sandwiching said piece of clothing therebetween, said fixation means being comprised by cooperating the first and second fixation flanges and the first and second fixation apertures provided at said inner shell part and said outer shell part, respectively.

2. The protective appliance according to claim 1, wherein said inner shell part has a circumferential rim of an elliptic configuration.

3. The protective appliance according to claim 2, wherein said first and second fixation flanges are located in a same plane as said circumferential rim.

4. A protective appliance to be worn by an individual for protecting a body part of said individual, which body part is covered by a piece of clothing, comprising:

an inner shell part of a convex configuration to be arranged such that one side of the inner shell part is covered by said piece of clothing at said body part of said individual, said inner shell part including opposite first and second fixation flanges and a central curved inner shell integrally connected to said fixation flanges, said fixation flanges having configurations allowing said fixation flanges to be arranged in contact with respective body surface parts adjacent to said body part of said individual, and said central curved inner shell bridging said fixation flanges so as to cover said body part of said individual without contacting said body part, as said fixation flanges are arranged in contact with said body surface parts;

an outer shell part to be arranged opposite to said inner shell part relative to said piece of clothing so as to sandwich said piece of clothing between said inner shell part and said outer shell part, the outer shell part having opposite first and second fixation apertures; and fixation means for fixating said inner shell part and said outer shell part relative to one another, sandwiching said piece of clothing therebetween, said fixation means being comprised by cooperating the first and second fixation flanges and the first and second fixation apertures provided at said inner shell part and said outer shell part, respectively.

5. The protective appliance according to claim 4, wherein said inner shell part has a circumferential rim of an elliptic configuration.

6. The protective appliance according to claim 5, wherein said first and second fixation flanges are located in a same plane as said circumferential rim.

7. The protective appliance according to claim 1, wherein said central curved inner shell of said inner shell part includes a plurality of apertures.

8. A protective appliance to be worn by an individual for protecting a body part of said individual, which body part is covered by a piece of clothing, comprising:

an inner shell part of a convex configuration to be arranged such that one side of the inner shell part is covered by said piece of clothing at said body part of said individual, said inner shell part including male locking means and a central curved inner shell integrally connected to said male locking means, said male locking means having configurations allowing said male locking means to be arranged in contact with respective body surface parts adjacent to said body part of said individual, and said central curved inner shell covering said body part of said individual without contacting said body part, as said male locking means are arranged in contact with said body surface parts;

an outer shell part to be arranged opposite to said inner shell part relative to said piece of clothing so as to sandwich said piece of clothing between said inner shell part and said outer shell part, the outer shell part having female locking means for locking with the male locking means; and fixation means for fixating said inner shell part and said outer shell part relative to one another, sandwiching said piece of clothing therebetween, said fixation means being comprised by cooperating male and female locking means provided at said inner shell part and said outer shell part.

9. The protective appliance according to claim 8, wherein said male locking means comprises opposite first and second fixation flanges on said outer shell part, and the female locking means comprises opposite first and second fixation apertures on said inner shell part.

10. The protective appliance according to claim 9, wherein said outer shell part is a bar of a flexible material.

11. The protective appliance according to claim 9, wherein said outer shell part has a convex configuration complementary to said convex configuration of said inner shell part.

12. The protective appliance according to claim 9, wherein said inner shell part is made from a flexible material.

13. A protective appliance to be worn by an individual for protecting a body part of said individual, which body part is covered by a piece of clothing, comprising:

an inner shell part of a convex configuration to be arranged such that one side of the inner shell part is covered by said piece of clothing at said body part of said individual, said inner shell part being made from a flexible material and including opposite first and second fixation flanges and a central curved inner shell integrally connected to said first and second fixation flanges, said central curved inner shell of said inner shell part comprising ventilation apertures, said first and second fixation flanges having configurations allowing said fixation flanges to be arranged in contact with respective body surface parts adjacent to said body part of said individual, and said central curved inner shell bridging said first and second fixation flanges so as to cover said body part of said individual without contacting said body part, as said first, and second fixation flanges are arranged in contact with said body surface parts;

an outer shell part to be arranged opposite to said inner shell part relative to said piece of clothing so as to sandwich said piece of clothing between said inner shell part and said outer shell part, the outer shell part having opposite first and second fixation apertures; and fixation means for fixating said inner shell part and said outer shell part relative to one another, sandwiching said piece of clothing therebetween, said fixation means being comprised by cooperating the first and second fixation flanges and the first and second fixation apertures provided at said inner shell part and said outer shell part, respectively.

14. A protective appliance to be worn by an individual for protecting a body part of said individual, which body part is covered by a piece of clothing, comprising:

an inner shell part of a convex configuration to be arranged such that one side of the inner shell part covers said piece of clothing at said body part of said individual, said inner shell part including opposite first and second fixation flanges and a central curved inner shell integrally connected to said fixation flanges, said fixation flanges having configurations allowing said fixation flanges to be arranged in contact with respective body surface parts adjacent to said body part of said individual, and said central curved inner shell bridging said fixation flanges so as to cover said body part of said individual without contacting said body part, as said fixation flanges are arranged in contact with said body surface parts;

an outer shell part to be arranged opposite to said inner shell part relative to said piece of clothing so as to sandwich said piece of clothing between said inner shell part and said outer shell part, the outer shell part having opposite first and second fixation apertures; and fixation means for fixating said inner shell part and said outer shell part relative to one another, sandwiching said piece of clothing therebetween, said fixation means being comprised by cooperating the first and second fixation flanges and the first and second fixation apertures provided at said inner shell part and said outer shell part, respectively.

15. A protective appliance to be worn by an individual for protecting a body part of said individual, which body part is covered by a piece of clothing, comprising:

an inner shell part of a convex configuration to be arranged such that one sidle of the inner shell part covers said piece of clothing at said body part of said individual, said inner shell part including opposite first and second fixation flanges and a central curved inner shell integrally connected to said fixation flanges, said fixation flanges having configurations allowing said fixation flanges to be arranged in contact with respective body surface parts adjacent to said body part of said individual, and said central curved inner shell bridging said fixation flanges so as to cover said body part of said individual without contacting said body part, as said fixation flanges are arranged in contact with said body surface parts;

an outer shell part to be arranged opposite to said inner shell part relative to said piece of clothing so as to sandwich said piece of clothing between said inner shell part and said outer shell part, the outer shell part having opposite first and second fixation apertures; and fixation means for fixating said inner shell part and said outer shell part relative to one another, sandwiching said piece of clothing therebetween, said fixation means being comprised by cooperating the first and second fixation flanges and the first and second fixation apertures provided at said inner shell part and said outer shell part, respectively.

16. A protective appliance to be worn by an individual for protecting a body part of said individual, which body part is covered by a piece of clothing, comprising:

an inner shell part of a convex configuration to be arranged such that one side of the inner shell part covers said piece of clothing at said body part of said individual, said inner shell part including male locking means and a central curved inner shell integrally connected to said male locking means, said male locking means having configurations allowing said male locking means to be arranged in contact with respective body surface parts adjacent to said body part of said individual, and said central curved inner shell covering said body part of said individual without contacting said body part, as said male locking means are arranged in contact with said body surface parts;

an outer shell part to be arranged opposite to said inner shell part relative to said piece of clothing so as to sandwich said piece of clothing between said inner shell part and said outer shell part, the outer shell part having female locking means for locking with the male locking means; and fixation means for fixating said inner shell part and said outer shell part relative to one another, sandwiching said piece of clothing therebetween, said fixation means being comprised by cooperating male and female locking means provided at said inner shell part and said outer shell part.

17. A protective appliance to be worn by an individual for protecting a body part of said individual, which body part is covered by a piece of clothing, comprising:

an inner shell part of a convex configuration to be arranged such that one side of the inner shell part covers said piece of clothing at said body part of said individual, said inner shell part being made from a flexible material and including opposite first and second fixation flanges and a central curved inner shell integrally connected to said first and second fixation flanges, said central curved inner shell of said inner shell part comprising opposite ventilation apertures, said first and second fixation flanges having configurations allowing said fixation flanges to be arranged in contact with respective body surface parts adjacent to said body part of said individual, and said central curved inner shell bridging said first and second fixation flanges so as to cover said body part of said individual without contacting said body part, as said first and second fixation flanges are arranged in contact with said body surface parts;

an outer shell part to be arranged opposite to said inner shell part relative to said piece of clothing so as to sandwich said piece of clothing between said inner shell part and said outer shell part, the outer shell part having opposite first and second fixation apertures; and fixation means for fixating said inner shell part and said outer shell part relative to one another, sandwiching said piece of clothing therebetween, said fixation means being comprised by cooperating the first and second fixation flanges and the first and second fixation apertures provided at said inner shell part and said outer shell part, respectively.

* * * * *

UNITED STATES PATENT AND TRADEMARK OFFICE

CERTIFICATE OF CORRECTION

PATENT NO. : 5,557,804

DATED : 24 September 1996

INVENTOR(S): Klaus Qvortrup and Henrik Jeppesen

It is certified that error appears in the above-identified patent and that said Letters Patent is hereby corrected as shown below:

On title page, item [75], Inventors "Klaus Ovortrup" should be corrected to --Klaus Qvortrup-- item [73], Assignee "Ovortrup ApS" should be corrected to --Qvortrup ApS--

On title page, item [19], "Ovortrup" should read --Qvortrup --.

Signed and Sealed this

Fourth Day of February, 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,557,804

DATED : September 24, 1996

INVENTOR(S) : Qvortrup et al.

It is certified that error appears in the above-identified patent and that said Letters Patent is hereby corrected as shown below:

On the title page, item [73],

"Assignee": "Ovortrup" should be --Qvortrup--

Col. 9, line 37, claim 1: "flange" should read --flanges--

Signed and Sealed this

Ninth Day of December, 1997

Bruce Lehman

*Attest:*

BRUCE LEHMAN

*Attesting Officer*

*Commissioner of Patents and Trademarks*